US006066054A

United States Patent [19]

Masutani

[11] Patent Number: 6,066,054

[45] Date of Patent: May 23, 2000

[54] GOLF BALL

[75] Inventor: Yutaka Masutani, Saitama, Japan

[73] Assignee: Bridgestone Sports Co., Ltd., Tokyo, Japan

[21] Appl. No.: 09/154,825

[22] Filed: Sep. 17, 1998

[30] Foreign Application Priority Data

Sep. 18, 1997 [JP] Japan ..... 9-253019

[51] Int. Cl.[7] ..... A63B 37/12

[52] U.S. Cl. ..... 473/374; 473/377

[58] Field of Search ..... 473/373, 374, 473/378, 377

[56] References Cited

U.S. PATENT DOCUMENTS 5,820,485 10/1998 Hwang ..... 473/378

5,830,086 11/1998 Hayashi et al. ..... 473/378 X 5,836,834 11/1998 Masutani et al. ..... 473/374

*Primary Examiner*—Raleigh W. Chiu

*Attorney, Agent, or Firm*—Sughrue, Mion, Zinn, Macpeak & Seas, PLLC

[57] ABSTRACT

A golf ball includes an outer cover having a high hardness and an inner cover having a low hardness. Projections are formed on the inner surface of the outer cover, and corresponding depressions are formed in the outer surface of the inner cover. The inner and outer covers are bonded while the projections are engaged with the depressions. The length of each projection in a normal direction is at least 60% of the thickness of a non-depression portion of the inner cover. The percentage of a total volume of all the projections with respect to a total volume of the inner cover and all the projections is 10% to 70%. The hardness difference between the projections and the inner cover is 5 to 40 on the Shore D Scale.

10 Claims, 1 Drawing Sheet

GOLF BALL

BACKGROUND OF THE INVENTION

1. Field of the Invention

The present invention relates to a golf ball having an outer cover, and an inner cover whose hardness is lower than that of the outer cover. More particularly it relates to a golf ball capable of providing a high ballistic trajectory while maintaining high resilience and capable of providing a player with good feel on impact.

2. Related Art

Generally, a softer golf ball exhibits a larger launch angle. Conventionally, therefore, in order to obtain a golf ball exhibiting a high ballistic trajectory with a large launch angle, a soft material is used to form at least one constituent layer of the golf ball. For example, a relatively soft rubber is used to form a core, or a relatively soft resin is used to form an inner or outer cover (may be referred to as an intermediate layer or a cover).

However, in the method of forming a core through use of a soft rubber, when the core is made excessively soft, the ball becomes excessively soft. As a result, in spite of a high ballistic trajectory, resilience decreases, and thus travel distance becomes relatively short. Further, upon a full shot (strong hit), the ball gives a player an impression like that of a coreless ball.

Also, during putting, a sound of the hit becomes low, giving an unfavorable impression to many players.

In the method of forming an inner or outer cover through use of a soft resin, when the resin is excessively soft or the resin layer is excessively thick, the ball becomes excessively soft. As a result, in spite of a high ballistic trajectory, resilience decreases, and thus travel distance becomes relatively short. Further, upon a full shot (strong hit), the ball gives a player an impression like that of a coreless ball.

SUMMARY OF THE INVENTION

The present invention has been achieved in view of the foregoing. An object of the present invention is to provide a golf ball capable of providing a large launch angle while maintaining high resilience and capable of causing a player to feel the presence of a core on impact upon a full shot.

To achieve the above object, the present invention provides a golf ball comprising an outer cover, and an inner cover whose hardness is lower than that of the outer cover. Projections are formed on the inner surface of the outer cover, and corresponding depressions are formed in the outer surface of the inner cover. The inner and outer covers are bonded while the projections are engaged with the depressions. The length of each projection in a normal direction is at least 60% of the thickness of a non-depression portion of the inner cover. The percentage of a total volume of all the projections with respect to a total volume of the inner cover and all the projections is 10% to 70%. A hardness difference between the projections and the inner cover is 5 to 40 on the Shore D Scale.

Preferably, the hardness of the projections of the outer cover is not less than 55 on the Shore D Scale, and the hardness of the inner cover is less than 55 on the Shore D Scale.

Further preferably, the projections are formed along substantially normal directions.

Still further preferably, the projections are formed in a substantially cylindrical shape, a substantially prismatic shape, a substantially conical shape, or a substantially pyramidal shape.

In the golf ball of the present invention, the projections formed on the outer cover having a relatively high hardness are fitted into the inner cover having a relatively low hardness. In other words, a number of high-hardness portions (projections) are embedded in the low-hardness inner cover (hereinafter, a layer composed of the inner cover and the embedded projections may be referred to as an intermediate layer). Because of the above structure, the intermediate layer concurrently exhibits a function of a soft layer and a function of a high-hardness layer.

Accordingly, when the golf ball of the present invention is subjected to a full shot, at which a very strong external force is applied to the ball by, for example, a driver or a long iron, the ball provides a large launch angle by virtue of a function of a soft layer effected by the intermediate layer. At the same time, the ball provides sufficient resilience and provides a player with a feel such as that given by the presence of a core, since the projections strongly react against the external force by means of a reaction force generated within the projections, and thus the intermediate layer intensively effects a function of a high-hardness layer.

When the golf ball of the present invention is subjected to a normal shot, at which an external force slightly weaker than that of a full shot is applied to the ball by, for example, a middle iron, a reaction force generated in the projections becomes smaller than that upon full shot, so that the ball provides a player with a soft feel on impact. At the same time, since the intermediate layer effects a function of a high-hardness layer to a considerable extent, the ball provides sufficient resilience.

Further, when the golf ball of the present invention is subjected to a control shot, at which a weak external force is applied to the ball by, for example, a short iron, a reaction force generated in the projections is small, and the intermediate layer does not effect a function of a high-hardness layer. Thus, the ball provides a player with a soft feel on impact and exhibits an intensive spin.

The golf ball of the present invention can provide a large larch angle while maintaining high resilience and can provide a player with good feel on impact upon a full shot.

DESCRIPTION OF THE INVENTION AND THE PREFERRED EMBODIMENT

Figure 1:
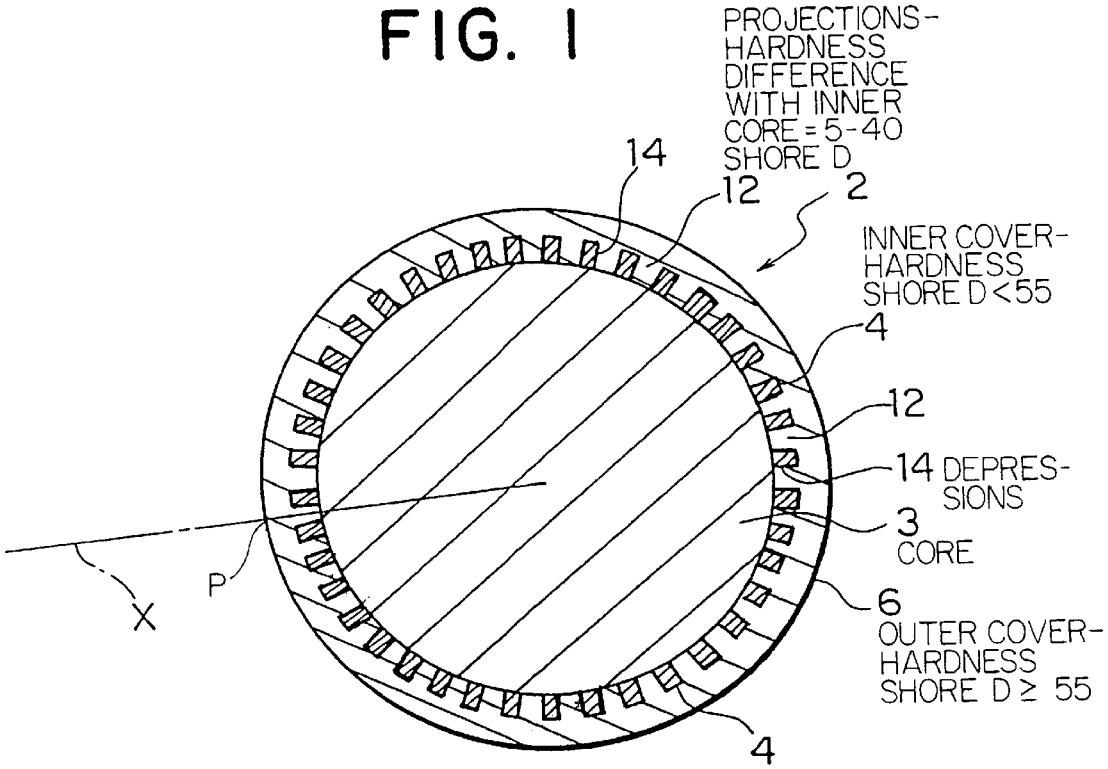
FIG. 1 is a sectional view showing an embodiment of a golf ball according to the present invention.

The present invention will now be described in detail. The material for a core is not particularly limited. An example of core material is vulcanized rubber which contains as a main component polybutadiene rubber, polyisoprene rubber, natural rubber, silicone rubber, or like rubber. Preferably, vulcanized rubber containing polybutadiene rubber as a main component is used. The core may have a single-layered structure made of a single type of material or a multi-layered structure composed of a plurality of layers each made of a different type of material.

The material for inner and outer covers is not particularly limited. Examples of cover material include an ionomer resin, a urethane resin, a polyester resin, a mixture of a polyurethane resin and a polyester resin, and a like resin. The inner and outer covers may each have a single-layered structure made of a single type of material or a multi-layered structure composed of a plurality of layers each made of a different type of material.

In the golf ball of the present invention, projections are formed on the inner surface of the outer cover, and corresponding depressions are formed in the outer surface of the inner cover. The inner and outer covers are bonded while the projections are engaged with the depressions. The shape of the projections is not particularly limited, but preferably they are substantially cylindrical, substantially prismatic, substantially conical, or substantially pyramidal. The diameter of the projections is normally 1.2 mm to 3.5 mm, but is not particularly limited thereto.

In the golf ball of the present invention, the length of each projection in a normal direction is at least 60% of the thickness of the non-depression portion of the inner cover. When the percentage is less than 60%, the intermediate layer fails to sufficiently exhibit the function of a high-hardness layer. As a result, the ball may fail to provide sufficient resilience upon a full shot or a normal shot or to provide a player upon a full shot with a feel such as that given by the presence of a core. The percentage is preferably set to be not less than 80%, more preferably set to 100%.

In the golf ball of the present invention, the percentage of a total volume of all the projections with respect to a total volume of the inner cover and all the projections, i.e., a percentage A as defined below, is 10% to 70%.

$$A(\%) = [C/(B+C)] \times 100$$

where $B$: volume of inner cover $C$: total volume of all projections

When the percentage A is less than 10%, the intermediate layer fails to sufficiently effect the function of a high-hardness layer. As a result, the ball may fail to provide sufficient resilience upon a full shot or a normal shot or to provide a player upon a full shot with a feel such as that given by the presence of a core. By contrast, when the percentage A is in excess of 70%, the intermediate layer fails to sufficiently effect a function of a soft layer. As a result, the ball may fail to provide a large launch angle upon a full shot. The percentage A is more preferably 20% to 50%, particularly preferably 25% to 40%.

In the golf ball of the present invention, a hardness difference between the projections of the outer cover and the inner cover is 5 to 40 on the Shore D scale. When the hardness difference falls outside the range, the inner cover becomes excessively hard or soft, or the outer cover becomes excessively soft or hard. In any of the cases, the intermediate layer fails to concurrently effect the a function of a soft layer and a function of a high-hardness layer. As a result, the object of the present invention cannot be achieved. The hardness difference is more preferably 10 to 30, particularly preferably 15 to 25, on the Shore D scale. In the outer cover, the hardness of the projections is normally identical to that of non-projection portions.

The hardness of the outer cover is not less than 55, preferably 55 to 70, on the Shore D scale. The hardness of the inner cover is less than 55, preferably 20 to less than 55, on the Shore D scale. These hardness ranges are adequate for obtaining a high ballistic trajectory and good feel on impact. The thickness of the non-projection portion of the outer cover is 0.5 mm to 4.0 mm, particularly 1.0 mm to 2.0 mm. The thickness of the non-depression portion of the inner cover is 0.5 mm to 4.0 mm, particularly 1.0 mm to 2.0 mm. However, the thickness ranges are not limited thereto.

In the present invention, formation of the projections along normal directions of the golf ball is preferred in that a reaction force is adequately generated in the projections against an external force applied to the golf ball and that the ball provides good symmetry. A normal in the present invention refers to, when a certain point on the surface of the golf ball is taken as P, a straight line x which passes through the point P and is perpendicular to a tangential plane at the point P, and thus corresponds to a line (a radial line) which connects the point P and the center of the golf ball (see FIG. 1). Accordingly, a projection formed along substantially a normal direction in the present invention denotes a projection whose axis extends along substantially a radial line of the golf ball.

The size and weight of the golf ball of the present invention conforms to the Golf Rules. Accordingly, the golf ball has a diameter not smaller than 42.67 mm and a weight not greater than 45.93 g.

Referring to FIG. 1, which shows a sectional view of an embodiment of a golf ball according to the present invention, a golf ball 2 is a 3-layered multi-piece solid golf ball composed of a core 3, an inner cover 4, and an outer cover 6. The inner cover 4 encloses the core 3 and is formed through use of a low-hardness resin having a hardness less than 55 on the Shore D Scale. The outer cover 6 encloses the inner cover 4 and is formed through use of a high-hardness resin having a hardness not less than 55 on the Shore D scale.

In the golf ball 2, a number of projections 12 are formed on the inner surface of the outer cover 6 along normals X, and a number of corresponding depressions 14 are formed in the outer surface 13 of the inner cover 4. The inner and outer covers 4 and 6, respectively, are bonded while the projections 12 are engaged with the depressions 14. The length of each projection 12 in a normal direction is at least 60% of the thickness of the non-depression portion of the inner cover 4. The percentage of a total volume of all the projections 12 with respect to a total volume of the inner cover 4 and all the projections 12 is 10% to 70%. A hardness difference between the projections 12 and the inner cover 4 is 5 to 40 on the Shore D scale.

The golf ball 2 of the present embodiment may be manufactured, for example, in the following procedure. However, the manufacturing procedure is not limited thereto.

(1) The core 3 is formed from vulcanized rubber through compression molding. Subsequently, the inner cover 4 having a number of the depressions 14 formed therein is formed on the surface of the core 3. Specifically, the inner cover 4 is injection-molded on the core 3 through use of a mold that has a number of projections formed on a cavity surface for forming the depressions 14. Alternatively, two hemispheric cups each having a number of the depressions 14 formed in an outer surface are manufactured through injection or compression molding. Subsequently, the core 3 is enclosed with the two hemispheric cups, followed by compression molding to form the inner cover 4 on the core 3. The inner cover 4 may be formed by any other appropriate method.

(2) The outer cover 6 is injection-molded on the inner cover 4, during which dimples are formed on the outer cover 6. In order to facilitate a flow of resin of the outer cover 6 into the depressions 14, the interior of a mold may be evacuated, as needed, through use of a vacuum pump.

Figure 2:
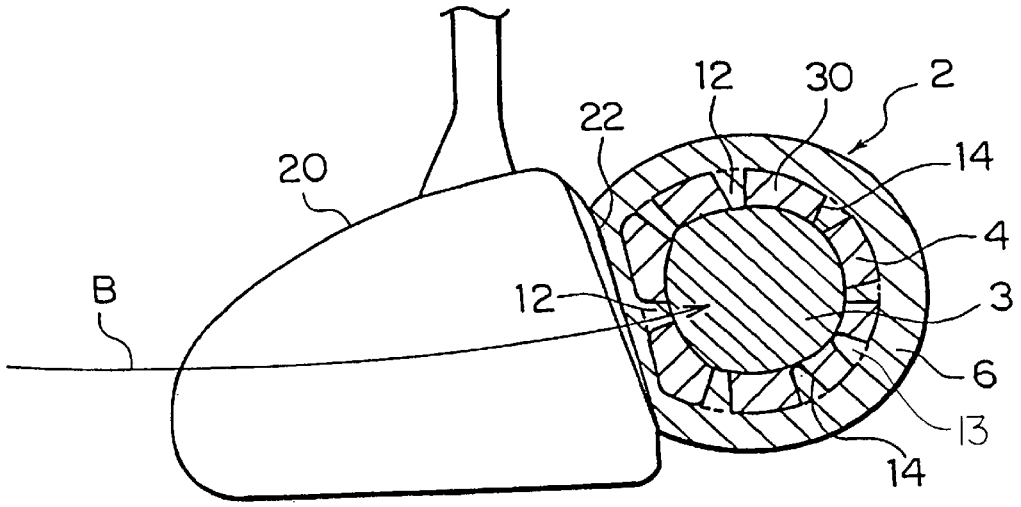
FIG. 2 is a schematic sectional view showing the action and effect of the golf ball of FIG. 1.

FIG. 2 schematically shows the action and effect of the golf ball 2 of FIG. 1. In order to help understand the condition of the projections 12 and relevant portions of the golf ball 2, FIG. 2 exaggeratively shows the thickness of the inner and outer covers 4 and 6, respectively, the length of the projections 12, etc. As shown in FIG. 2, when the golf ball 2 of the present embodiment is subjected to a full shot, at which a very strong external force is applied to the ball 2 by a driver 20 or a like club, the ball 2 provides a large launch angle by virtue of a function of a soft layer effected by an intermediate layer 30. At the same time, the ball 2 provides sufficient resilience and provides a player with a feel such as that given by the presence of a core, since the projections 12 strongly react against the external force by means of a reaction force generated within the projections 12, and thus the intermediate layer 30 intensively effects a function of a high-hardness layer. Not shown in FIG. 2, but when the golf ball 2 is subjected to a normal shot, at which an external force slightly weaker than that of a full shot is applied to the ball 2 by a middle iron or a like club, or when the golf ball 2 is subjected to a control shot, at which a weak external force is applied to the ball 2 by a short iron or a like club, the ball 2 provides the effect and action described previously.

EXAMPLES

Golf balls of Examples 1 to 3 and Comparative Examples 1 to 4 shown in Table 1 were manufactured. In Table 1, a base rubber was obtained by blending JSR BR01 and JSR BR11 (trade names of polybutadiene rubbers manufactured by Japan Synthetic Rubber Co., Ltd.) at the weight ratio 50:50; a vulcanizer was PERCUMYL D (trade name of a dicumyl peroxide manufactured by Nippon Oil & Fats Co., Ltd.); and a hardener was zinc acrylate. Also, in the "Inner cover—composition" field of Table 1, polyester was Hitrel H4047 manufactured by Du Pont-Toray Co., Ltd.; ionomer B was obtained by blending SURLYN 8120 manufactured by Du Pont, Ltd. and HIMILAN 1855 manufactured by Du Pont-Mitsui Polychemicals Co., Ltd. at the weight ratio 65:35; and ionomer C was obtained by blending SARIN 8120 and HIMILAN 1855 at the weight ratio 50:50. In the "Outer cover—composition" field of Table 1, ionomer A was obtained by blending HIMILAN 1605 and HIMILAN 1706 at the weight ratio 50:50. In the "Golf ball—hardness" field of Table 1, hardness was represented by the amount of deformation of a ball as measured under a load of 100 kg.

TABLE 1

| | Examples | | | Comparative Examples | | | |
|---|---|---|---|---|---|---|---|
| | 1 | 2 | 3 | 1 | 2 | 3 | 4 |
| Composition of Core: (parts by weight) | | | | | | | |
| Base rubber | 100 | 100 | 100 | 100 | 100 | 100 | 100 |
| Zinc oxide | 30 | 30 | 30 | 30 | 30 | 30 | 30 |
| Vulcanizer | 1.2 | 1.2 | 1.2 | 1.2 | 1.2 | 1.2 | 1.2 |
| Hardener | 18 | 18 | 18 | 18 | 18 | 18 | 18 |
| Core weight (g) | 29.2 | 29 | 29.2 | 28.9 | 29.1 | 29 | 29.1 |
| Inner Cover: | | | | | | | |
| Composition | Polyester | Ionomer B | Polyester | Polyester | Ionomer C | Polyester | Polyester |
| Thickness (mm) *1 | 2.0 | 2.0 | 1.7 | 1.7 | 2.0 | 1.9 | 1.7 |
| Hardness (Shore D) | 40 | 51 | 40 | 40 | 59 | 40 | 40 |
| Outer Cover: | | | | | | | |
| Composition | Ionomer A | Ionomer A | Ionomer A | Ionomer A | Ionomer A | Ionomer A | Ionomer A |
| Thickness (mm) *2 | 2.0 | 2.0 | 2.0 | 2.0 | 2.0 | 2.0 | 2.0 |
| Hardness (Shore D) | 63 | 63 | 63 | 63 | 63 | 63 | 63 |
| Projection: | | | | | | | |
| Shape | Conical | Conical | Cylindrical | Cylindrical | Conical | Conical | No |
| Percentage of length (%) | 100 | 100 | 60 | 50 | 100 | 60 | Projections- |
| Percentage of volume (%) | 22 | 53 | 68 | 56 | 53 | 9 | — |
| Hardness Difference (Shore D) *3 | 23 | 12 | 23 | 23 | 4 | 23 | 23 |
| Golf Ball: | | | | | | | |
| Outer diameter (mm) | 42.70 | 42.75 | 42.72 | 42.69 | 42.72 | 42.73 | 42.70 |
| Weight (g) | 45.28 | 45.3 | 45.31 | 45.29 | 45.3 | 45.3 | 45.31 |
| Hardness (mm) *4 | 3.02 | 2.79 | 3 | 3.06 | 2.88 | 3.04 | 3.09 |
| Travel Test | | | | | | | |
| Initial speed (m/s) W1:HS50 | 77.01 | 77.1 | 76.95 | 76.8 | 76.9 | 76.86 | 76.78 |
| Launch angle (degrees) | | | | | | | |
| W1:HS50 | 9.9 | 9.7 | 10.1 | 10 | 9.7 | 9.9 | 10.1 |
| W1:HS45 | 9.5 | 9.8 | 9.6 | 9.5 | 9.5 | 9.5 | 9.5 |
| I5:HS40 | 12.3 | 11.8 | 12.4 | 12.2 | 11.7 | 12.2 | 12.2 |
| SW:HS25 | 36.5 | 35.9 | 36.5 | 36.2 | 35.G | 36.2 | 36.1 |
| Spin speed (rpm) | | | | | | | |
| W1:HS50 | 2275 | 2320 | 2281 | 2283 | 2332 | 2268 | 2288 |
| W1:HS45 | 2131 | 2224 | 2089 | 2150 | 2096 | 2125 | 2071 |

TABLE 1-continued

| | Examples | | | Comparative Examples | | | |
|---|---|---|---|---|---|---|---|
| | 1 | 2 | 3 | 1 | 2 | 3 | 4 |
| I5:H540 | 4953 | 5120 | 4932 | 4978 | 5203 | 4988 | 4994 |
| SW:HS25 | 4288 | 4697 | 4292 | 4358 | 4873 | 4427 | 4471 |
| Feel on Impact | 0 | 0 | 0 | x1 | x2 | x1 | x1 |

*1 Thickness of non-depression portion
*2 Thickness of non-projection portion
*3 Hardness difference between projections of outer cover and inner cover
*4 Deformation of ball under a load of 100 kg The golf balls of Examples 1 to 3 and Comparative Examples 1 to 4 were subjected to the following travel test and feel-on-impact test.

Travel Test:

Through use of a hitting test machine, the following values were measured.

Initial speed, launch angle, and spin speed when the golf balls were hit by the No. 1 wood (W1) at a head speed of 50 m/s (HS50).

Launch angle and spin speed when the golf balls were hit by the No. 1 wood (W1) at a head speed of 45 m/s (HS45).

Launch angle and spin speed when the golf balls were hit by the No. 5 iron (I5) at a head speed of 40 m/s (HS40).

Launch angle and spin speed when the golf balls were hit by the sand wedge (SW) at a head speed of 25 m/s (HS25).

Feel-on-Impact Test:

The golf balls were subjected to the feel-on-impact test in which three professional golfers hit the golf balls and evaluated feel on impact. Evaluation criteria for feel on impact is as follows:

o: Soft feel on impact upon normal shot, and upon full shot feel such as that given by the presence of a core x1: Soft feel on impact upon normal shot, but upon full shot absence of feel such as that given by the presence of a core x2: Somewhat hard feel on impact upon both normal shot and full shot The test results are shown in Table 1. As seen from Table 1, the golf balls of the present invention of Examples 1 to 3 exhibit a launch angle and a spin motion substantially similar to those of the golf ball of Comparative Example 4, which is a conventional high-ballistic-trajectory golf ball having a soft inner cover, provide an initial speed higher than that of the golf ball of Comparative Example 4 by virtue of improved resilience, and provided the players upon full shot with a feel such as that given by the presence of a core.

In the golf ball of Comparative Example 1 in which the length of each projection in a normal direction is less than 60% of the thickness of the non-depression portion of the inner cover, the intermediate layer composed of the inner cover and the projections embedded in the inner cover failed to sufficiently provide a function of a hard layer; consequently, the ball failed to provide the players upon full shot with a feel such as that given by the presence of a core. In the golf ball of Comparative Example 2 in which a hardness difference between the projections of the outer cover and the inner cover is less than 5 on the Shore D scale, the intermediate layer failed to provide a function of a soft layer since the inner cover was excessively hard. As a result, the ball provided the players with a hard feel on impact upon both normal shot and full shot. In the golf ball of Comparative Example 3 in which the percentage of a total volume of all the projections with respect to a total volume of the inner cover and all the projections is less than 10%, the intermediate layer failed to sufficiently provide a function of a hard layer; consequently, the ball failed to provide the players upon full shot with a feel such as that given by the presence of a core.

What is claimed is:

1. A golf ball comprising:

a core; an inner cover formed to cover said core, said inner cover having depressions formed in the outer surface of said inner cover; and an outer cover formed to cover said inner cover, said outer cover having a hardness greater than that of said inner cover and having projections that are formed on the inner surface of said outer cover to correspond to the depressions of said inner cover, said inner and outer covers being bonded while the projections being engaged with the depressions, wherein the length of each projection in a normal direction is at least 60% of the thickness of a non-depression portion of said inner cover;

the percentage of a total volume of all the projections with respect to a total volume of said inner cover and all the projections is 10% to 70%, a hardness difference between the projections and said inner cover is 5 to 40 on the Shore D scale;

the thickness of the non-projection portion of the outer cover is 0.5 mm to 4.0 mm; and the thickness of the non-depression portion of the inner cover is 0.5 mm to 4.0 mm.

2. A golf ball according to claim 1, wherein the length of each projection in a normal direction is at least 80% of the thickness of the non-depression portion of said inner cover.

3. A golf ball according to claim 1, wherein the length of each projection in a normal direction is 100% of the thickness of the non-depression portion of said inner cover.

4. A golf ball according to claim 1, wherein the percentage of the total volume of all the projections with respect to the total volume of said inner cover and all the projections is 20% to 50%.

5. A golf ball according to claim 1, wherein the hardness difference between the projections and said inner cover is 10 to 30 on the Shore D Scale.

6. A golf ball according to claim 1, wherein the hardness of the projections of said outer cover is not less than 55 on the Shore D Scale, and the hardness of said inner cover is less than 55 on the Shore D Scale.

7. A golf ball according to claim 1, wherein the hardness of the projections of said outer cover is 55 to 70 on the Shore D Scale, and the hardness of said inner cover is 20 to less than 55 on the Shore D Scale.

8. A golf ball according to claim 1, wherein the diameter of said projections is 1.2 mm to 3.5 mm.

9. A golf ball according to claim 1, wherein the projections are formed along substantially normal directions.

10. A golf ball according to claim 1, wherein the projections are formed in a substantially cylindrical shape, a substantially prismatic shape, a substantially conical shape, or a substantially pyramidal shape.

* * * * *